US005761568A

United States Patent [19]

Haragakiuchi et al.

[11] Patent Number: 5,761,568

[45] Date of Patent: Jun. 2, 1998

[54] ELECTRO-PHOTOGRAPHIC APPARATUS HAVING TRANSFER BIAS CONTROL

[75] Inventors: Hideyuki Haragakiuchi; Hiroyuki Tadokoro; Nobuaki Fukasawa; Akira Sasaki; Isamu Terashima; Masashi Yamamoto, all of Hitachi, Japan

[73] Assignee: Hitachi, Ltd., Tokyo, Japan

[21] Appl. No.: 773,837

[22] Filed: Dec. 27, 1996

Related U.S. Application Data

[63] Continuation of Ser. No. 212,767, Mar. 15, 1994, abandoned.

[30] Foreign Application Priority Data

Mar. 15, 1993 [JP] Japan ..... 5-053552

[51] Int. Cl.[6] ..... G03G 15/00

[52] U.S. Cl. ..... 399/44; 399/45; 399/66

[58] Field of Search ..... 399/44, 45, 66, 399/314

[56] References Cited

U.S. PATENT DOCUMENTS

| | | | |
|---|---|---|---|
| 3,837,741 | 9/1974 | Spencer | 355/274 |
| 3,877,416 | 4/1975 | Donohue . | |
| 4,134,147 | 1/1979 | Watanabe | 361/235 |
| 4,912,515 | 3/1990 | Amemiya et al. | 399/44 |
| 5,019,871 | 5/1991 | Takeda et al. | 355/309 |
| 5,119,141 | 6/1992 | Bhagat | 355/274 |
| 5,128,717 | 7/1992 | Uchikawa et al. | 399/44 |
| 5,148,218 | 9/1992 | Nakane et al. | 399/9 |
| 5,182,598 | 1/1993 | Hara et al. | 355/208 |
| 5,231,452 | 7/1993 | Murayama et al. | 355/208 |
| 5,276,483 | 1/1994 | Hasegawa et al. | 355/208 |
| 5,287,144 | 2/1994 | Takeda | 355/208 |
| 5,291,253 | 3/1994 | Kumasaka et al. | 355/275 |

FOREIGN PATENT DOCUMENTS

| | | |
|---|---|---|
| 0028081 | 2/1980 | Japan . |
| 0017468 | 2/1983 | Japan . |
| 0060756 | 4/1983 | Japan . |
| 0300774 | 12/1990 | Japan . |
| 0190381 | 7/1992 | Japan . |
| 5-019580 | 1/1993 | Japan . |

*Primary Examiner*—Robert Beatty

*Attorney, Agent, or Firm*—Antonelli, Terry, Stout & Kraus, LLP

[57] ABSTRACT

An electrophotographic imaging apparatus includes a toner image holding body, a transcription unit for transcribing the toner image on the toner image holding body onto a recording medium, and a conveyor for conveying a recording medium toward the toner image holding body and transcription unit. A judging device will judge whether printing is of a first page or not and if it is decided that printing is to be performed on a first page, a first measuring device will measure the electrical characteristic of the toner image holding body prior to the feeding of a recording medium and a transcription voltage will be set depending of this measured result. Thereafter, the recording medium will be conveyed toward the transcription unit where the electrical characteristics of the non-printing region on the recording medium will be measured via a second measuring device and the transcription voltage will be further adjusted. If it is judged that the recording sheet is not the first sheet, only the second measuring and adjusting will be performed. In this manner, transcribing of a toner image can always be performed regardless of the kind of paper being used and/or changes in the environment (temperature, humidity) and a high transcribing efficiency can be attained.

8 Claims, 16 Drawing Sheets

FIG. 6
| | |
|---|---|
| MEDIA A 1Y → | VA1 |
| MEDIA A 2Y → | VA2 |
| MEDIA A 3Y → | VA3 |
| MEDIA A 4Y → | VA4 |
| | |
| MEDIA B 1Y → | VB1 |
| MEDIA B 2Y → | VB2 |
| MEDIA B 3Y → | VB3 |
| MEDIA B 4Y → | VB4 |
FIG. 8(a)
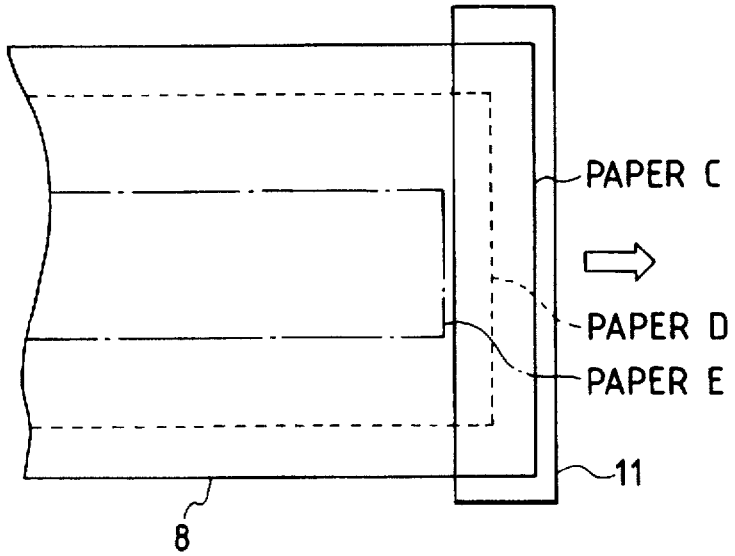
FIG. 8(b)
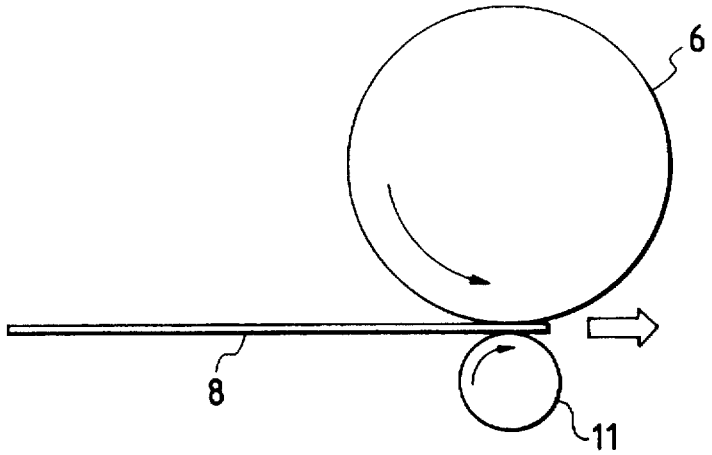

ELECTRO-PHOTOGRAPHIC APPARATUS HAVING TRANSFER BIAS CONTROL

This application is a continuation application of Ser. No. 08/212,767, filed Mar. 15, 1994, now abandoned.

BACKGROUND OF THE INVENTION

The present invention relates to an electro-photographic printer, such as a laser printer, or an electro-photographic apparatus, such as an electro-photographic copying machine, and more particularly to an optimum transcribing control unit for a transcription apparatus to transcribe (i.e., electro-photographically develop and transfer) a toner image onto paper.

The toner transcription apparatus in an electrophotographic apparatus of this kind develops and transfers a toner image from a toner image holding body onto paper. There are some kinds of electric-photographic apparatus in which a toner image on a toner image holding body is transferred to paper in such a way that, in order to transfer the image, the paper acting as a recording medium is passed to an arrangement of a toner roller and a transcribing roller to which is applied a transcribing (i.e., a scanning) voltage.

A transcription apparatus of this kind has the disadvantage that the transcribing performance changes due to a change in the electric resistances of the recording medium and of the transcribing roller corresponding to a change in environmental conditions. FIG. 15 shows the transcribing characteristic depending on temperature which is one of the relevent environmental conditions. The transcribing voltage is set so as to obtain an optimum transcribing efficiency at normal temperature and normal humidity (for example, 20° C., 60%RH) as an environmental condition in which the transcribing efficiency is established as 100%.

That is, the transcribing efficiency is measured with varying humidities, from low humidity to high humidity, assuming both a sunny day and rainy day. It can be understood from this characteristic graph that the transcribing efficiency substantially decreases at a humidity different from the environmental humidity at which the transcribing voltage has been set (referring to characteristic curve I in the figure).

For this reason, a transcription apparatus of this kind controls the transcribing voltage applied to the transcribing roller by detecting the resistance of the recording medium to prevent the degradation of transcribing efficiency (referring to characteristic curve II in the figure), described, for example, in Japanese Patent Application Laid-Open No. 55-28081 (1980), Japanese Patent Application Laid-Open No. 2-300774 (1990) and Japanese Patent Application Laid-Open No. 4-190381 (1992).

However, it has become a recent requirement is recently required that the electro-photographic printer and electro-photographic transcription apparatus must be capable of transcribing images onto various kinds of recording media (materials and sizes); however, the control unit in the conventional transcription apparatus cannot cope with this requirement.

SUMMARY OF THE INVENTION

An object of the present invention is to provide an electro-photographic apparatus having a transcription apparatus which is always capable of maintaining a very high transcribing efficiency in the face of changes in environmental conditions and the kinds of recording media to be used.

The object of the present invention can be attained by providing an electro-photographic apparatus which comprises toner image forming means for forming a toner image on a rotating toner image holding body, conveying means for conveying a recording medium on which the toner image formed on the toner image holding body is transcribed, a transcription unit to transcribe the toner image from the toner image holding body onto the recording medium conveyed by the conveying means, fixing means for fixing the toner image on the recording medium, the transcription unit having transcribing voltage control means for controlling a transcribing voltage while measuring the electric characteristic of the recording medium being used, wherein the transcribing voltage control means comprises control characteristic changing means for changing the transcribing voltage control characteristic based on the measured electric characteristic corresponding to a kind of recording medium being used.

Otherwise, the object of the present invention can be attained by providing an electro-photographic apparatus which comprises toner image forming a means for forming toner image on a rotating toner image holding body, conveying means for conveying a recording medium on which the toner image formed on the toner image holding body is transcribed, a transcription unit to transcribe the toner image from the toner image holding body onto the recording medium conveyed by the conveying means, remaining charge removing any means for removing remaining transcribed charge on the recording medium after transcribing the toner image, fixing means for fixing the toner image on the recording medium, the transcription unit having transcribing voltage control means for controlling a transcribing voltage while measuring the electric characteristic of the recording medium, wherein the transcribing voltage control means comprises electric characteristic measuring means for measuring the electric characteristic of the recording medium being used under a condition in which the charge removing function by the remaining charge removing means is stopped, control characteristic changing means for changing the transcribing voltage control characteristic based on the measured electric characteristic corresponding to an environmental change and a kind of recording medium being used.

Since the transcribing voltage control means changes the transcribing voltage control characteristic based on the measured electric characteristic of the paper being used depending on the environmental change and a kind of paper (material and/or size), a transcribing voltage suitable for the paper can be applied to the transcribing roller even when paper of a different material, such as paper for a plain paper copier or paper for an overhead projector, is used and/or the paper size is changed. Therefore, a high transcribing efficiency can be maintained independent of the materials and sizes of the paper being used.

Further, since the measurement of the electric characteristic of the paper is performed by detecting the load current flowing through the transcribing roller under the condition in which the alternating current discharging unit is stopped, noise in detecting a very weak load current can be decreased, and a high detecting accuracy can be consequently attained to improve reliability.

BRIEF DESCRIPTION OF THE DRAWINGS

FIG. 6 is a data table formed in a read only memory in the control unit in an embodiment of a color laser printer in accordance with the present invention.

FIGS. 8(*a*) and 8(*b*) are schematic views showing the relationship between the transcribing drum and roller and the paper size in a transcription unit of transcribing roller type in an electro-photographic apparatus.

DETAILED DESCRIPTION OF THE PREFERRED EMBODIMENTS

An embodiment of a color laser printer, which is a kind of color image electro-photographic apparatus, according to the present invention as will be described in detail with reference to the accompanying drawings.

Figure 14:
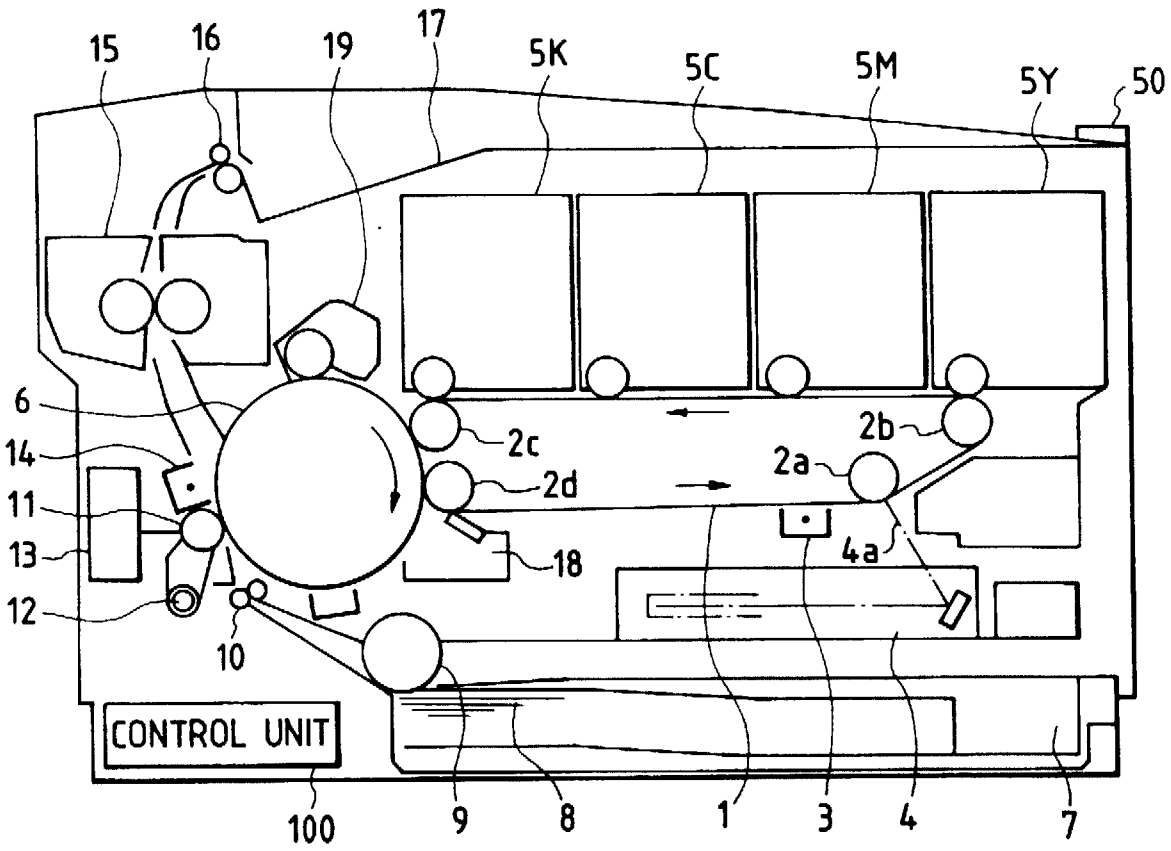
FIG. 14 is a vertical cross-sectional side view of an embodiment of a color laser printer in accordance with the present invention.
Figure 15:
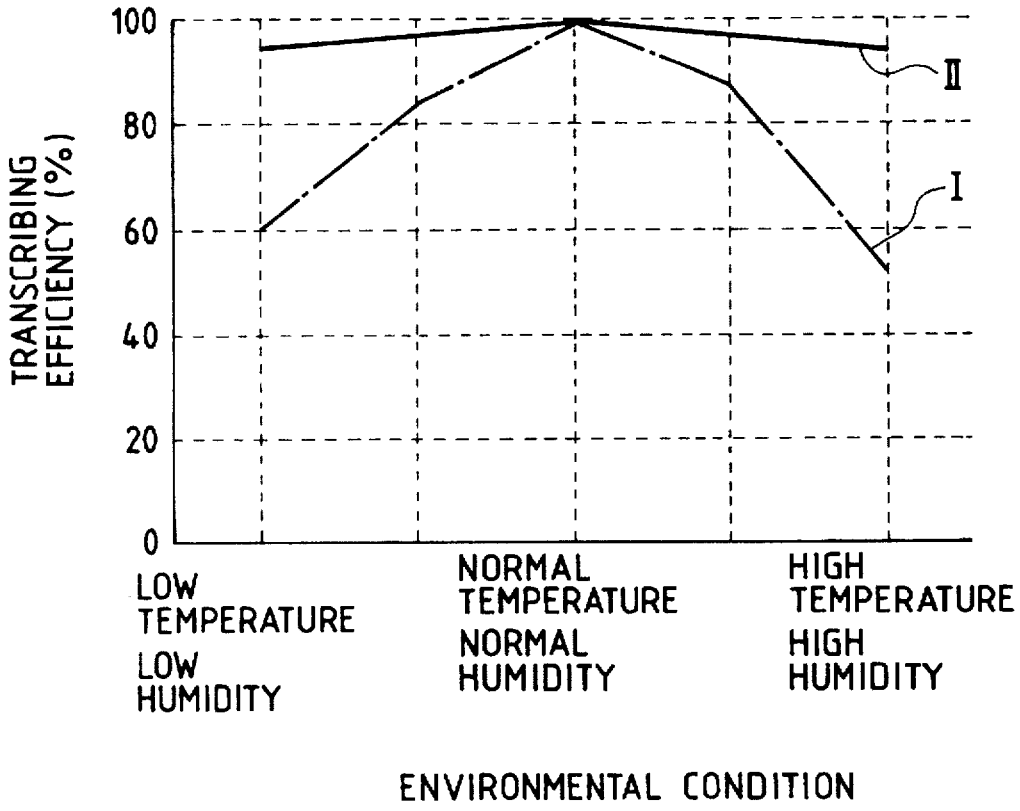
FIG. 15 is a diagram showing the transcribing characteristic of a transcription unit of the transcribing roller type in an electro-photographic apparatus.

FIG. 14 is a vertical side view of a color laser printer. A photosensitive belt 1, which is rotated with a constant speed around guide rollers 2*a* to 2*d*, is uniformly charged with a charging unit 3, is then exposed by a laser beam 4*a* radiated from an exposing unit 4 according to image signals for each color to form electrostatic latent images corresponding to each color successively, and the electrostatic latent images are then developed by successively selecting a developing unit using a developer corresponding to each color from four developing units 5Y, 5M, 5C, 5K to form a toner image of each color. Each of the toner images of a respective color on the outer surface of the photosensitive belt 1 is transferred and superposed on the outer surface of a transcribing drum 6 rotating in synchronization with and in contact relationship with the photosensitive belt 1 to form a color toner image on the outer surface of the transcribing drum 6.

Paper 8, representing as a recording medium stored in a paper feed cassette 7, is extracted and transmitted to a register roller 10 by a paper feed roller 9, by which it is conveyed to a transcribing roller 11 after rearranging the paper and controlling the conveying thereof to correspond in timing with the color toner image on the outer surface of the transcribing drum 6.

The transcribing roller 11, which forms part of the transcription apparatus, transfers the color toner image on the outer surface of the transcribing drum 6 onto the paper 8 by applying a mechanical pressing force and a transcribing electric field on the transmitted paper 8 from the back side thereof in contacting relationship with the transcribing drum 6 in order to transcribe the color toner image from the transcribing drum 6 onto the paper 8. Therein, the transcribing roller 11 is pulled up by a transcribing roller touching and detaching unit 12, so as to not interfere in the process in which the toner images for each color on the photosensitive belt 1 are being transferred to the outer surface of the transcribing drum 6, and is pushed out toward the transcribing drum 6 so as to participate in the process in which the color toner image is being transferred from the transcribing drum 6 onto the paper 8. The transcribing voltage applied to the transcribing roller 11 to generate the transcribing electric field is supplied from a power source 13 which is capable of changing the output voltage arbitrarily and continuously in response to the duty ratio of an input signal or the like.

The alternating current discharging unit 14, which generates an alternating corona applied alternating current makes the paper 8 easy to be separated from the transcribing drum 6 by neutralizing and discharging the charge remaining on the back side surface of the paper 8 which carries the color toner image. The paper 8 separated from the transcribing drum 6 is conveyed to a fixing unit 15, the color toner image being thermally fixed on the surface of the paper 8 as it passes through the fixing unit 15. The paper 8 having the thermally fixed color toner image is released onto a discharged paper tray 17 through a paper discharging roller 16.

A belt cleaner 18 cleans the photosensitive belt 1 by removing any remaining toner on the surface thereof, and a drum cleaner 19 cleans the transcribing drum 6 by removing toner on the surface thereof. However, the drum cleaner 19 is pulled up so as to not operate during the process in which transcribing of a single color toner image to the outer surface of the transcribing drum 6 is repeated to form a color toner image, and is pushed out toward the transcribing drum 6 so as to perform its cleaning function only after the color toner image has been completed and has been transferred onto the paper 8.

A control unit 100 controls each of the composing means described above corresponding to the input signal from an operating panel 50 and the input signal from an information processor which will be described later.

Figure 1:
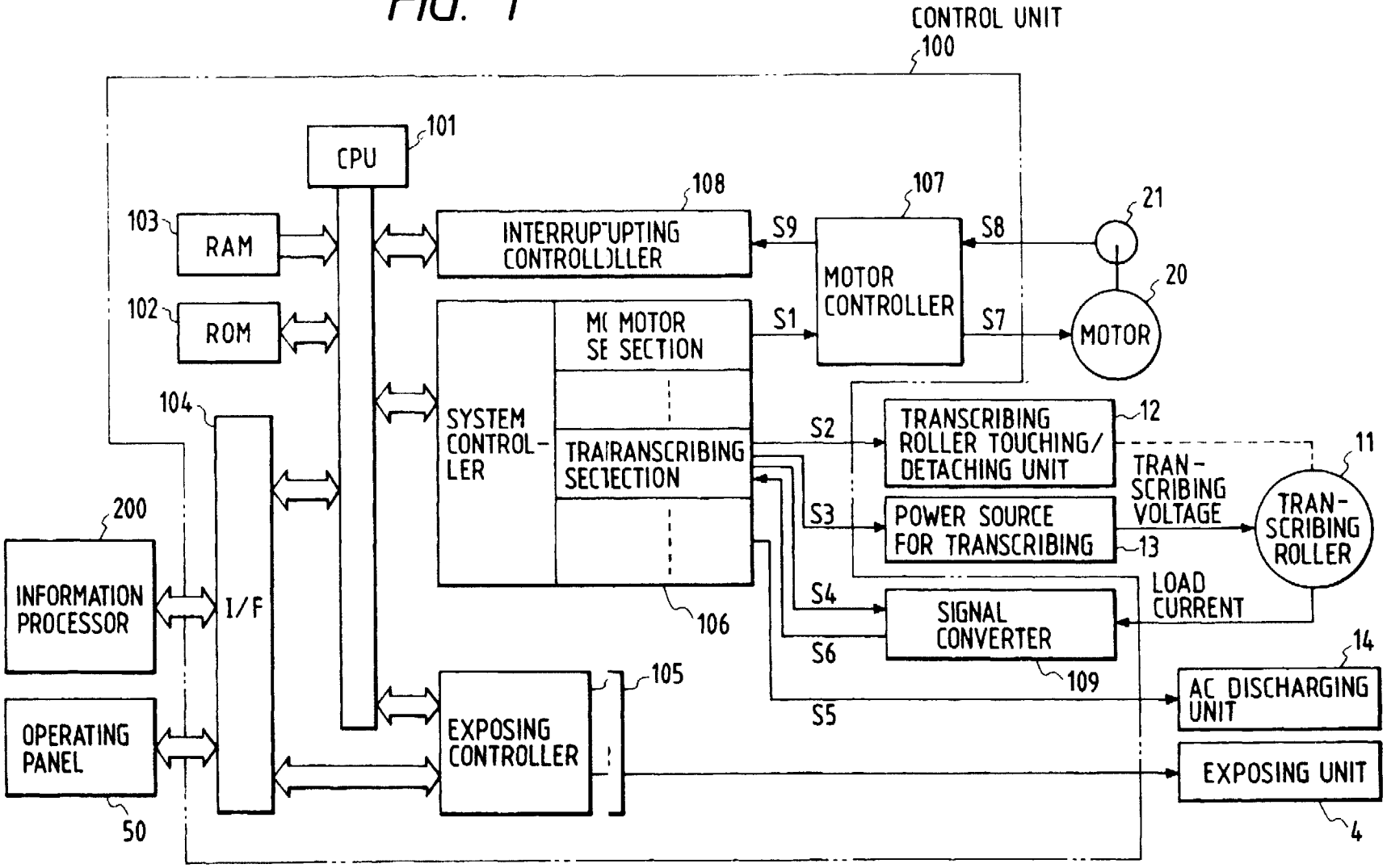
FIG. 1 is a block diagram showing details of a control unit in an embodiment of a color laser printer in accordance with the present invention.

FIG. 1 is a block diagram showing the details of the control unit 100 in the color laser printer. The control unit 100 mainly comprises a central processing unit 101, a read only memory 102 storing a control program for the central processing unit 101, a random access memory 103 serving as a work memory which the central processing unit 101 uses for executing the control program.

An input/output interface (I/F) 104 mediates communication between the central processing unit 100 and the operating panel 50 or the information processor 200, such as a word processor, personal computer and the like, and transmits the printing data generated by the information processor 200 to a exposing controller 105. The exposing controller 105 controls the exposing unit to generate the laser beam 4*a*.

A system controller 106 is a group of control sections which control a group of systems of the electrophotographic process, and is controlled by the central processing unit 101 to output a motor driving instruction signal S1, a transcribing roller touching/detaching signal S2 to drive the transcribing roller touching/detaching unit 12, a transcribing voltage control signal S3 to control the output voltage of the power source 13, a media kind signal S4, and an alternating current discharging control signal S5 to control operating/stopping of the alternating current discharging unit 14, in response to a characteristic detected signal S6 representing the measured electric characteristic of the paper 8.

A motor controller 107 is connected so as to control a motor 20 to drive the photosensitive belt 1, to control the conveying roller 9 and the fixing unit 15 and so on, by generating a driving signal S7 according to the motor driving instruction signal S1 supplied from the system controller 106, and is responsive to a detected signal S8 representing an angular displacement generated from an encoder 21, which is directly connected to the rotating shaft of the motor 20. The motor controller 107 receives the detected signal S8 from the encoder 21 and supplies a rotating angular signal S9 to the central processing unit 101 through an interrupting controller 108.

Figure 2:
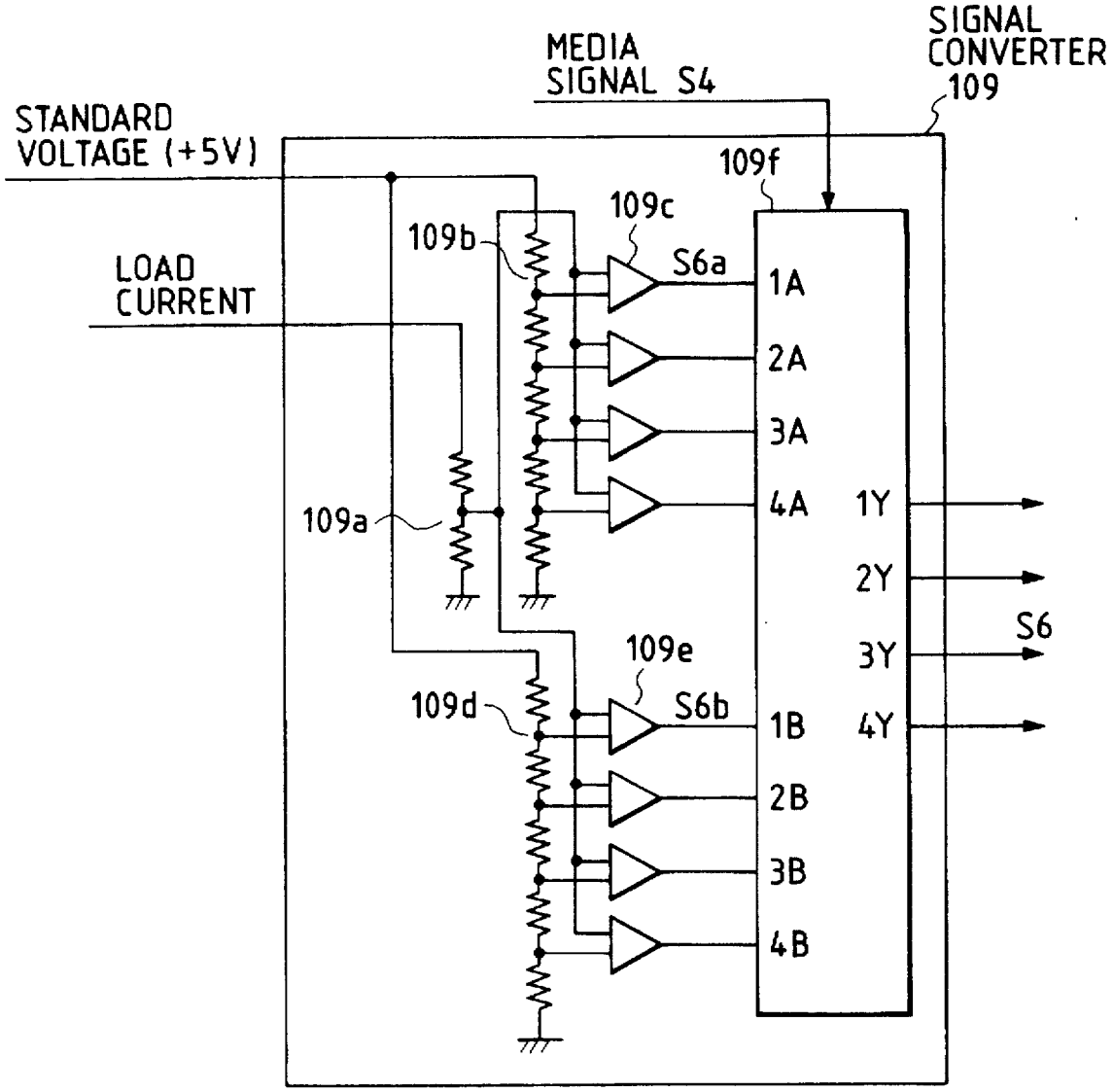
FIG. 2 is a block diagram showing details of a signal converting section in an embodiment of a color laser printer in accordance with the present invention.

A signal converter 109 comprises, as shown in FIG. 2, a conversion resistance 109*a* to convert the load current flowing through the transcribing roller 11 into a voltage signal proportional to the current flowing through it, a first group of voltage dividing resistances 109*b* to generate a first group of comparing standard voltages for converting the magnitude of the voltage signal from an analog signal into a digital signal with a first converting characteristic, a first group of comparators 109*c* to output a first converting signal S6*a* by comparing each voltage signal with a respective one of the first group of comparing standard voltages, a second group of voltage dividing resistances 109*d* to generate a second group of comparing standard voltages for converting the magnitude of the voltage signal from an analog signal into a digital signal with a second converting characteristic, a second group of comparators 109*e* to output a second converting signal S6*b* by comparing each voltage signal with a respective one of the second group of comparing standard voltages, a selector 109*f* to output a characteristic detected signal S6 by inputting the two converted signals S6*a* and S6*b* and selecting one from the two signals corresponding to the media kind signal S4.

Figure 3:
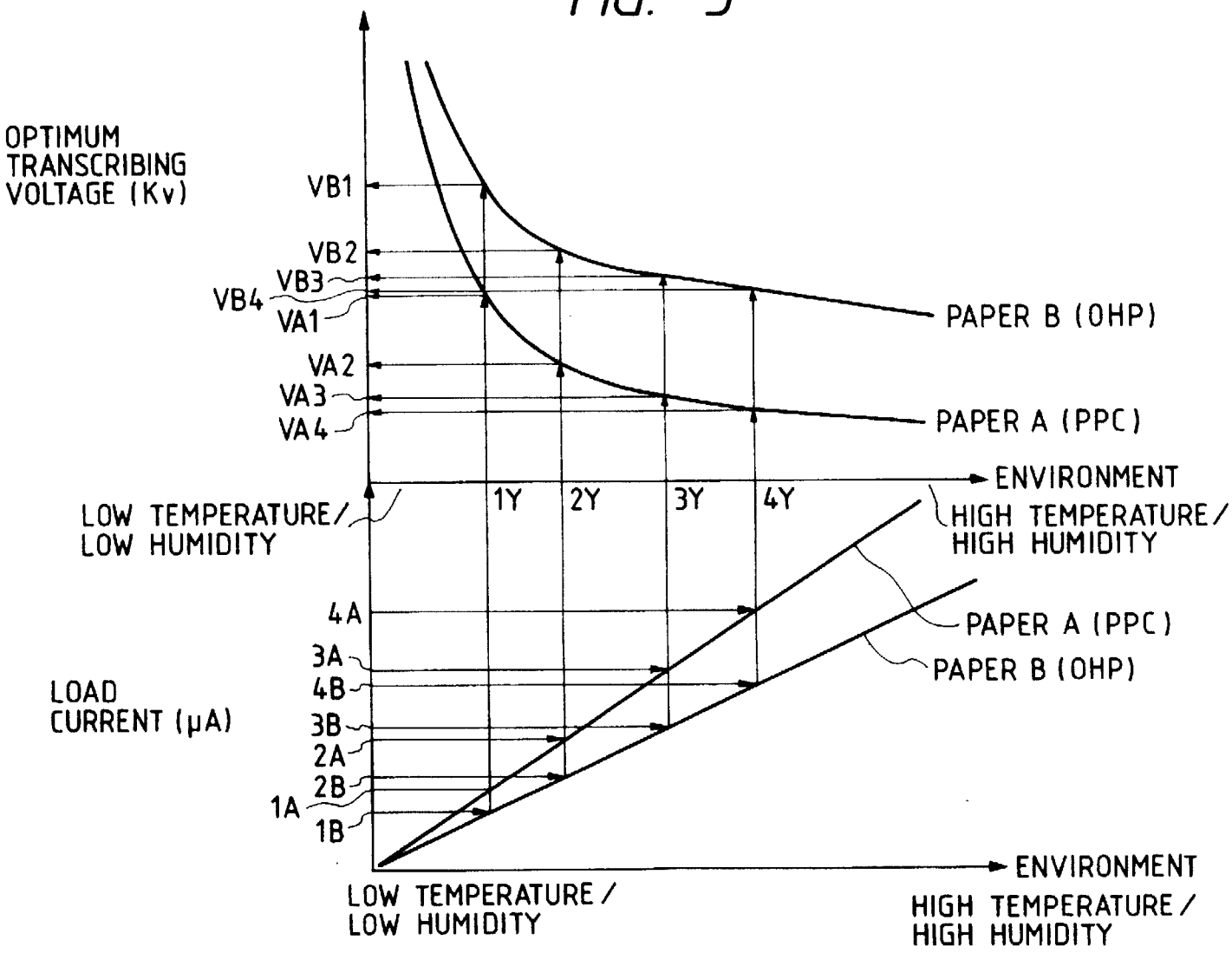
FIG. 3 is a diagram showing the optimum transcribing voltage characteristic of a transcription unit in an embodiment of a color laser printer in accordance with the present invention.

The first and the second converting characteristics in the signal converter 109 are selectively used to realize the transcribing voltage control in which it is taken into consideration that the transcribing roller load current and the optimum transcribing voltage characteristic depend on the material (paper for plain paper copier or paper for overhead projector) of the paper 8 being used. The load current, which flows to the transcribing roller 11 by applying a transcribing voltage in order to measure the electric characteristic of the paper 8, and the optimum transcribing voltage, which is to be applied corresponding to the load current, depend on the paper for a plain paper copier (paper A) or the paper for an overhead projector (paper B) as shown in FIG. 3. In detecting the load current corresponding the environment humidity, when the paper for a plain paper copier is used, the first converted signal obtained from the first group of voltage dividing resistances 109*b* and the first group of comparators 109*e* is selectively output as the characteristic detected signal S6. And, when the paper for overhead projector is used, the second converted signal obtained from the second group of voltage dividing resistances 109*c* and the second group of comparators 109*f* is selectively output as the characteristic detected signal S6.

The central processing unit 101 obtains the optimum transcribing signal corresponding to the paper A or the paper B as the characteristic detected signal S6 through the system controller 106, and executes the control processing to make the system controller 106 generate the transcribing voltage control signal S3 which generates the optimum transcribing voltage from the power supply 13 for the particular paper. Although the media kind information to discriminate between paper A and paper B is obtained from the input information input into the operating panel 50 by an operator, it may be possible to provide an automatic paper kind detector in the paper feed portion.

The color toner image transcribing control for the paper in such a color laser printer will be described below, referring to the flow chart of FIG. 4 and the time chart of FIG. 5. The transcribing control starts after completion of the forming of a color toner image on the outer surface of the transcribing drum 6.

When the transcribing control starts, a motor rotating process 401 to generate a motor driving instruction signal S1 from the system controller 106 is initiated in order to start operation of the motor 20 at the time T0.

At the time T1, paper feed starting process 402 is executed to rotate the paper feed roller 9 in order to extract paper 8 stored in the paper feed cassette 7 and to convey the paper 8 to the register roller 10.

At the time T2, the paper feeding is finished in the paper feed completing process 403, and the paper is then rearranged and the paper conveying timing is adjusted to take into account the position of the color toner image on the outer surface of the transcribing drum 6 in the paper conveying starting process 404. The transcribing roller touching/detaching driving signal S2 to operate the transcribing roller touching/detaching unit 12 so as to press the transcribing roller 11 to the transcribing drum 6 is generated from the system controller 106 in the transcribing roller pressing process 405. Then, the kind of the paper 8 used (paper for plain paper copier or paper for overhead projector) is judged based on the input information set in the operating panel 50 or the detected signal from the detector in the paper kind judging process 406, and the media kind signal S4 is generated from the system controller 106 in the media signal transmitting process 407.

At the time T3, the transcribing voltage control signal S3 is generated from the system controller 106 so as to apply the transcribing voltage in order to measure the electric characteristic of the paper 8 in the transcribing voltage apply for measuring process 408. The time described above is prior to the time when the top front edge of the paper 8 conveyed from the register roller 10 reaches the place between the transcribing drum 6 and the transcribing roller 11. In the transcribing voltage apply for measuring process 408, the transcribing voltage is controlled so as to gradually increase so that a given magnitude of the transcribing voltage may be applied to the transcribing roller 11 at the time T4.

At the time T4, the load current measuring process 409 starts. The load current measuring is performed at the time when a fixed value of t1 has elapsed since the paper feed starting process 402, within the interval t2 when the transcribing voltage is stabilizing and within the interval p1 when the top front edge of the paper 8 is within a non-printing region. The measured load current is converted to the characteristic detected signal S6 corresponding to kind of the paper 8 by the signal converter 109 so as to be transmitted to the system controller 106. It is judged in the process 410 whether the characteristic detected signal S6 is normal or abnormal. If normal, the processing goes to the process 412. If abnormal, error processing is executed in the error process 411, and then the motor stopping process 420, which will be described later, is executed to stop the transcribing control.

When the characteristic signal is normal, the transcribing voltage generating process 412 is started at the time T5. In this process 412, the data needed to generate an optimum transcribing voltage corresponding to the characteristic detected signal S6 is selected from a data table which has been stored in advance in the read only memory 10 corresponding to the characteristic detected signal S6, and the transcribing voltage to apply to the transcribing roller 11 from the power source 13 is optimized by changing the transcribing voltage signal S3 generated by the system controller 106 based on the data.

FIG. 6 shows the data table described above as formed in the read only memory 102. In a case where the paper 8 is paper for a plain paper copier, a transcribing voltage control signal S3 is generated referring to the voltage data for a group of media A. In a case where the paper 8 is paper for an overhead projector, a transcribing voltage control signal S3 is generated referring to the voltage data for a group of media B.

The time T6 is the timing for starting the transcribing of a color toner image. At this time, AC discharging control signal S5 to bring the alternating current discharging unit 14 into an operating condition is generated from the system controller 106 in the process 413, and the transcribing managing process 414 is started. Therewith, the color toner image on the outer surface of the transcribing drum 6 is transferred to the paper 8, the paper having received the transferred color toner image being thereafter discharged by the alternating current discharger 14 and separated from the transcribing drum 6 so as to be conveyed to the fixing unit 15. The color toner image transcription is started at the time T6 when a fixed value of t3 has elapsed following start of the paper feed process 402, within the interval t4 when the optimum transcribing voltage is stabilizing and before the time when the paper 8 is on the boundary between a non-printing region p1 and a printing region p2.

The paper transmitting completion process 415 is executed at the time T7.

At the time T8, the transcribing of the color toner image from the transcribing drum 6 to the paper 8 is completed. By detecting this timing in the transcribing managing process 414, the transcribing voltage control signal S3 is changed so that the generation of the transcribing voltage is stopped in the process 416, the AC discharging control signal S5 being changed so that the operation of the alternating current discharging unit 14 is stopped, and the transcribing roller touching/detaching driving signal S2 being changed so that the transcribing roller 11 is detached from the transcribing drum 6 in the process 418.

At the time T9, it is judged in the completion judging process 419 whether printing is to be continued or has been completed using the signal from the input/output interface 104. When printing is to be continued, the processing returns to the paper feed starting process 402 to perform the transcribing control process for the next page. When printing has been completed, the motor driving instruction signal S1 is changed so that the motor 20 is stopped in the process 420, and the transcribing control process is completed.

According to the transcribing voltage control described above, since the transcribing voltage control characteristic based on the measured electric characteristic of paper is changed depending on the kind of the paper been used, a transcribing voltage suitable for the paper can be applied to the transcribing roller 11 even when paper of different material, such as paper for a plain paper copier or paper for an overhead projector, is used in a color printer. Therefore, a high transcribing efficiency can be maintained independent of the material of the paper 8.

Further, since the measurement of the electric characteristic of the paper 8 is performed by detecting the load current flowing through the transcribing roller 11 under the condition in which the alternating current discharging unit 14 is stopped, noise in detecting a very weak load current can be decreased, and a high detecting accuracy can be consequently attained to improve reliability.

Figure 7:
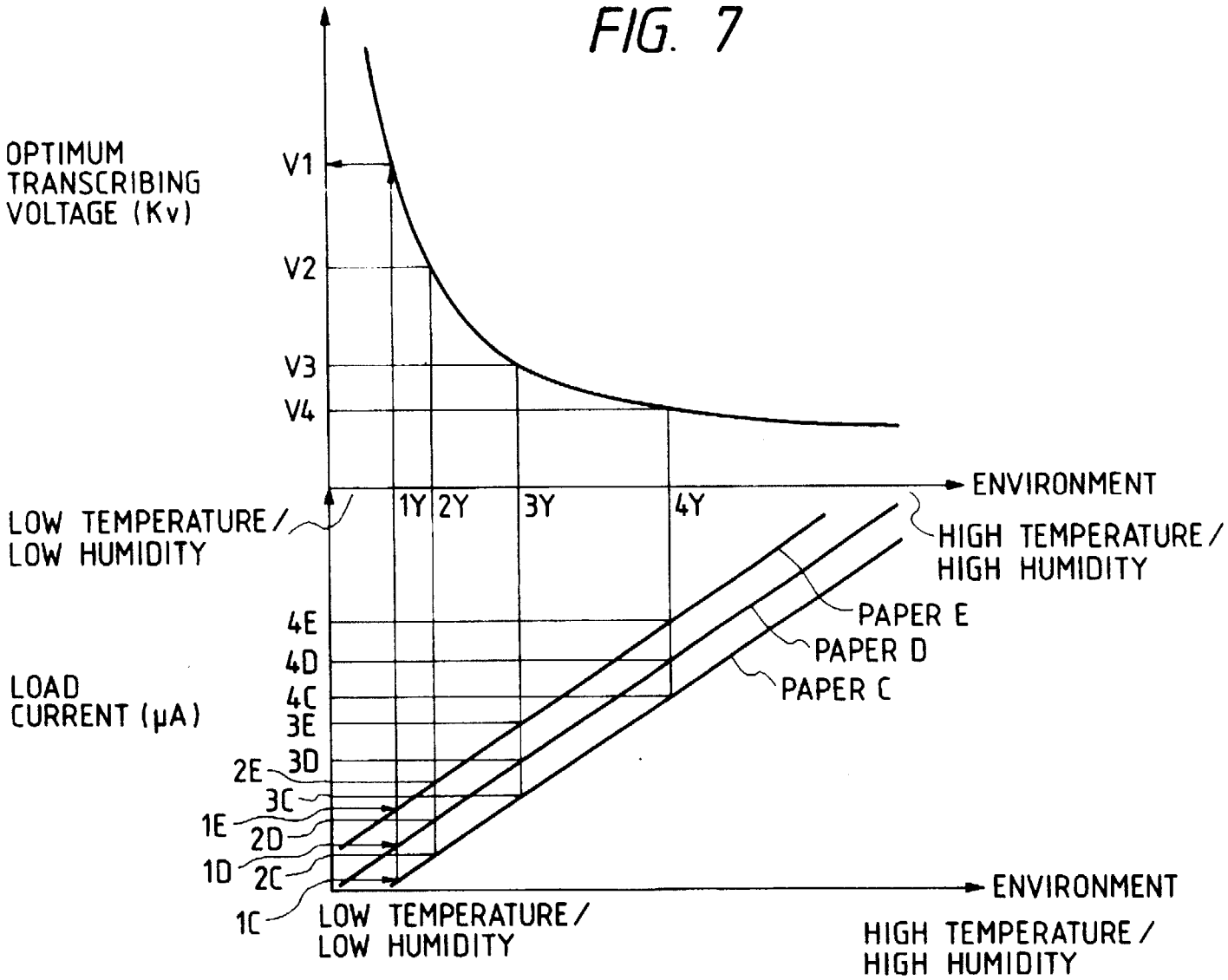
FIG. 7 is a diagram showing the optimum transcribing voltage characteristic for a paper size of the transcription unit of the transcribing roller type in an electro-photographic apparatus.

Although, in the embodiment described above, the control characteristic of the transcribing voltage is changed depending on the material of the paper 8, both the measured electric characteristic and the optimum characteristic of the transcribing voltage corresponding to the measured electric characteristic will also vary with the size of the paper 8. FIG. 7 shows that the corresponding relationship between the load current and the optimum transcribing voltage changes with a change in the size (especially, lateral width) of the paper 8 even when the same kind of paper is used, taking paper for a plain paper copier as an example. This seems to be caused by the fact that a leakage current which will not pass through the paper 8 appears, as shown in FIGS. 8(*a*) and 8(*b*), due to contact between the transcribing drum 6 and the transcribing roller 11 during electric characteristic measuring of the paper 8 and during transcribing, and so the magnitude of the leakage current varies with the size of the paper.

Therefore, it is desirable to perform a transcribing voltage control while taking the paper size into consideration for an electro-photographic apparatus using paper 8 of plural sizes. A transcribing voltage control which takes the paper size into consideration can be obtained by modifying the control unit 100 described using FIG. 1 as shown in FIG. 9 and FIG. 10.

Figure 9:
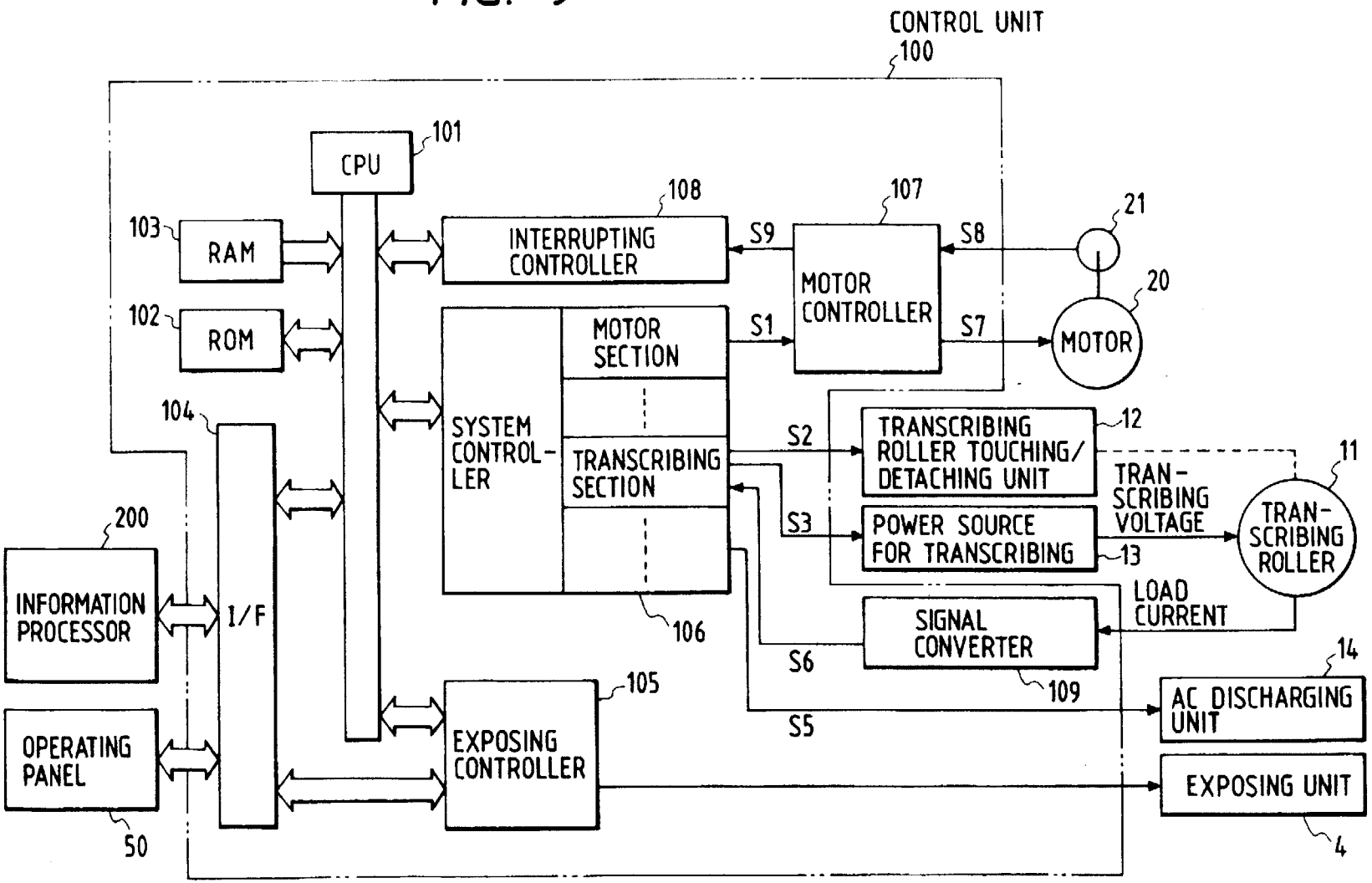
FIG. 9 is a block diagram showing details of a modified control unit in a further embodiment of a color laser printer in accordance with the present invention.

The control unit 100 in the embodiment shown in FIG. 9 is different from the one in FIG. 1 only to the extent that the control program and the data table stored in the read only memory 102 and the structure of the signal converter 109 are modified.

Figure 10:
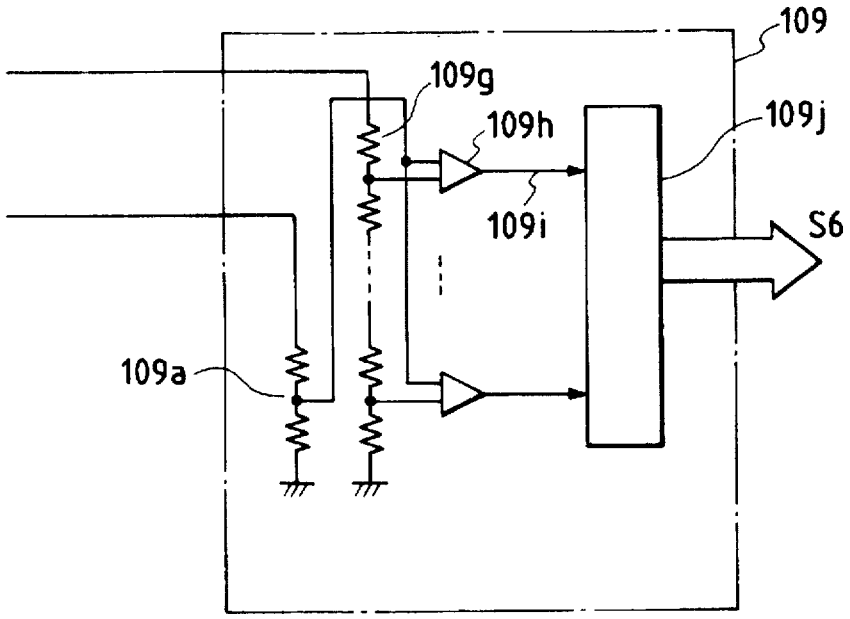
FIG. 10 is a block diagram showing the details of a signal converter in the control unit shown in FIG. 9.

The signal converter 109 in this embodiment, as shown in FIG. 10, comprises a conversion resistance 109*a* to convert the load current flowing through the transcribing roller 11 into a voltage signal, a group of voltage dividing resistances 109*g* to generate a group of comparing standard voltages for converting the magnitude of the voltage signal from an analog signal into a digital signal, a group of comparators 109*h* to output a comparing signal 109*i* by comparing each voltage signal with a respective one of the group of comparing standard voltages, and an encoder 109*j* which receives the comparing signal and outputs a characteristic detected signal S6 of n-bit.

Figure 11:
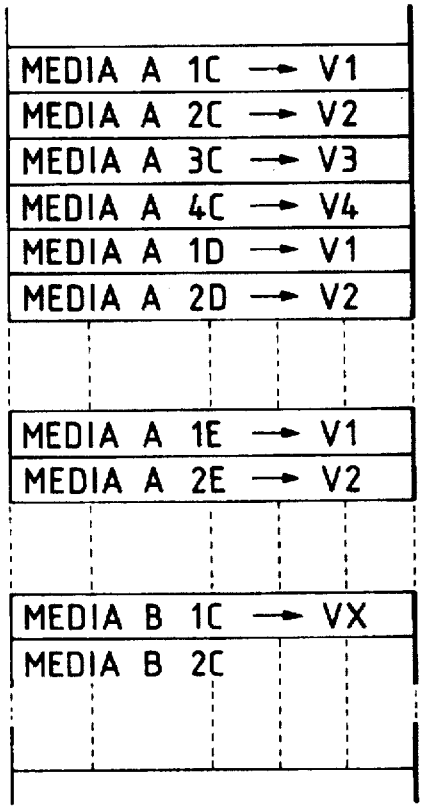
FIG. 11 is a data table formed in a read only memory in the control unit shown in FIG. 9.
Figure 12:
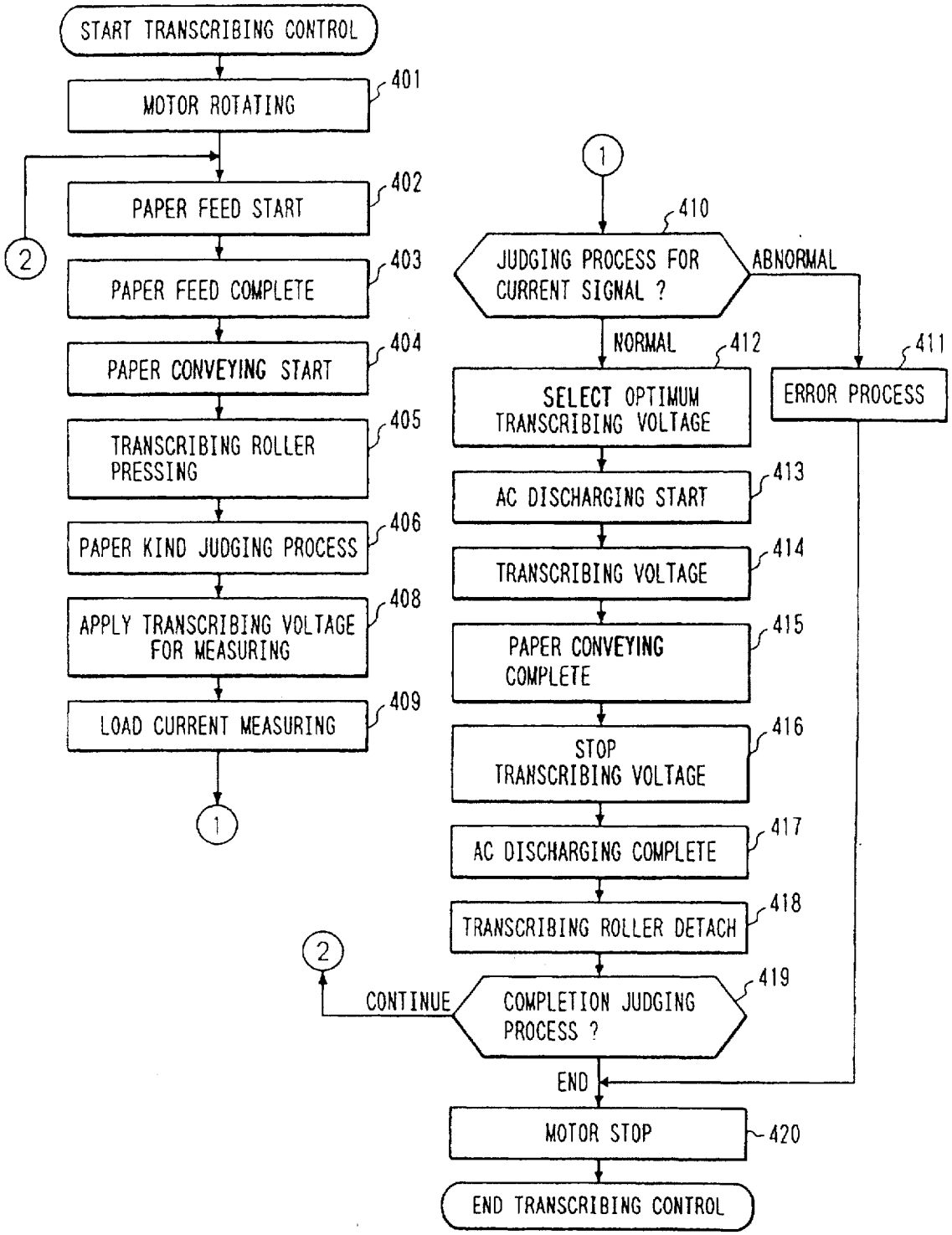
FIG. 12 is a flow chart showing the control program performed by the control unit shown in FIG. 9.

Further, a data table stored in the read only memory 102 is constructed so as to generate an optimum transcribing voltage corresponding to the paper size for the material of the paper 8 and the characteristic detected signal. The data table contains, as shown in FIG. 11, the characteristic detected signal S6 (1C, 2C, . . . 1D, 2D, . . .) and the optimum transcribing voltage data (V1, V2, . . .) for the various sizes (C, D, E) of the paper for a plain paper copier (media A) and the paper for an overhead projector (media B).

Figure 4:
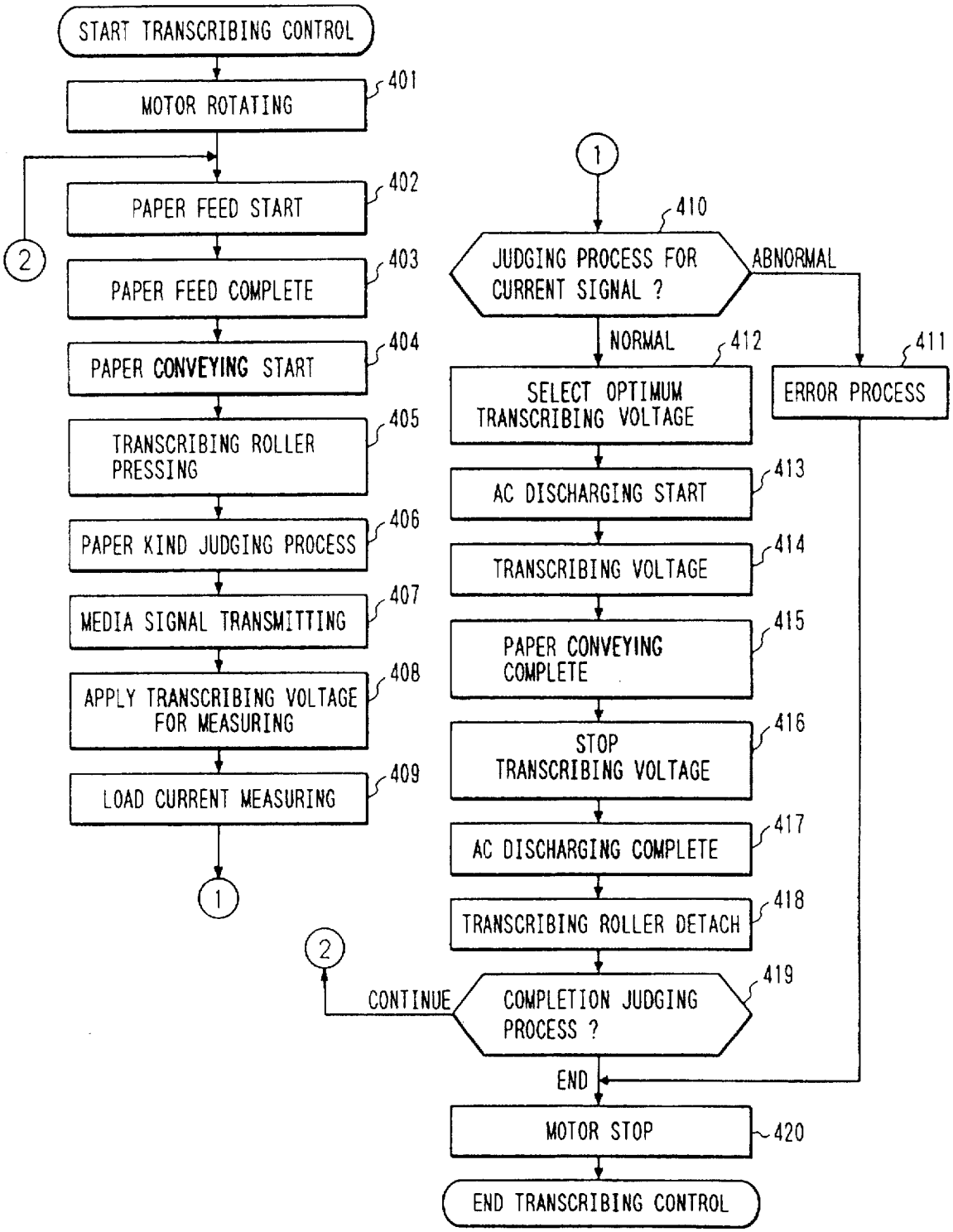
FIG. 4 is a flow chart showing the control program performed by the control unit in an embodiment of a color laser printer in accordance with the present invention.
Figure 5:
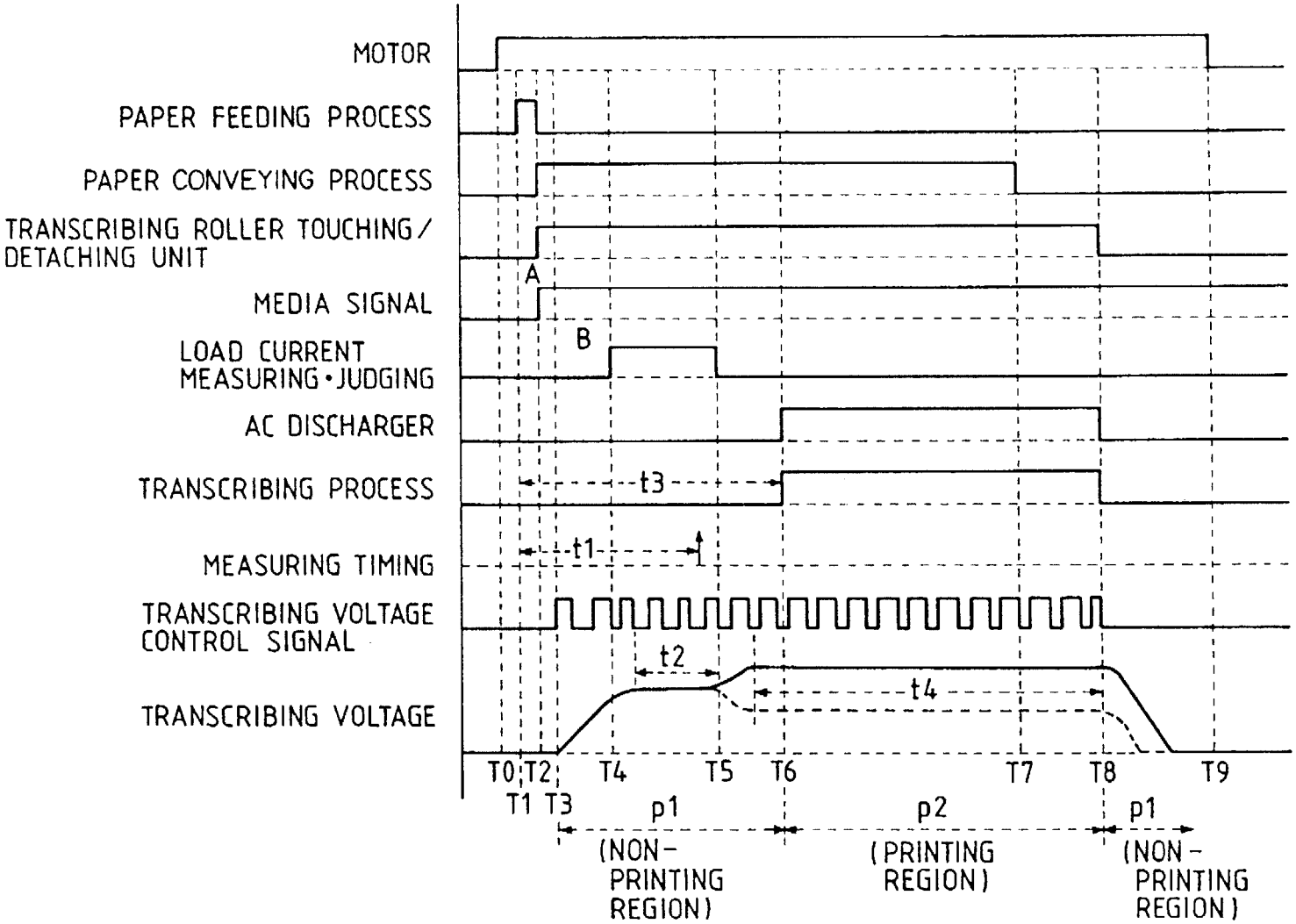
FIG. 5 is a time chart showing the control performed by the control unit in an embodiment of a color laser printer in accordance with the present invention.
Figure 13:
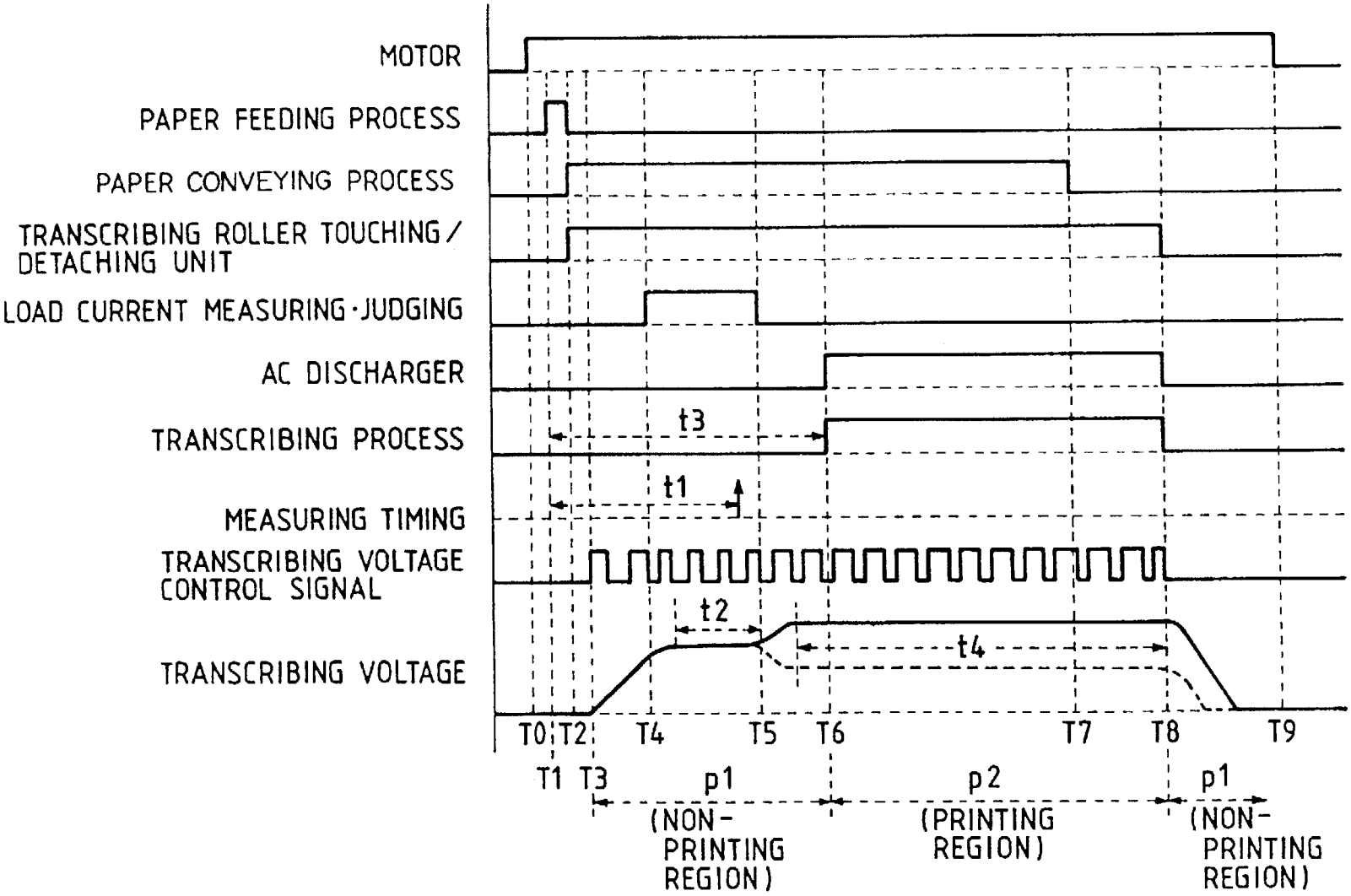
FIG. 13 is a time chart showing the control performed by the control unit shown in FIG. 9.

The control program is constructed by eliminating the media kind signal generating process from the program shown in FIG. 4. In the paper kind judging process 406 in this embodiment, a judging process for the kind of paper being used (discrimination of material, paper for plain paper copier or paper for overhead projector) is executed based on the input information set in the operating panel 50 or a detected signal from the detector. And, in the process 412, data to produce an optimum transcribing voltage corresponding to the characteristic detected signal S6 and the material and size of the paper 8 is selected from the data table, which has been stored in the read only memory 102 in advance, by referring to the signal S6 and the material and size. Based on this data, a transcribing voltage control signal S3 generated from the system controller 106 is changed to optimize the transcribing voltage supplied from the power source 13 and applied to the transcribing roller 11. The operating timings are, as shown in FIG. 13, the same as those in FIG. 5 except for the media signal generation.

According to the transcribing voltage control described above, since the transcribing voltage control characteristic based on the measured electric characteristic of the paper is changed depending on the kind of the paper (material and size), a transcribing voltage suitable for the paper can be applied to the transcribing roller 11 even when paper of a different material, such as paper for a plain paper copier or paper for an overhead projector, and of different size, is used in a color printer. Therefore, a high transcribing efficiency can be maintained independent of the characteristics of the paper 8.

Further, since the measurement of the electric characteristic of the paper 8 is performed by detecting the load current flowing through the transcribing roller 11 under a condition in which the alternating current discharging unit 14 has been stopped, noise in detecting a very weak load current can be decreased, and a high detecting accuracy can be consequently attained to improve reliability.

Incidentally, for an electro-photographic apparatus in which the material of the paper 8 to be used is limited only to paper for a plain paper copier, the material of paper 8 can be excluded from consideration.

Figure 16:
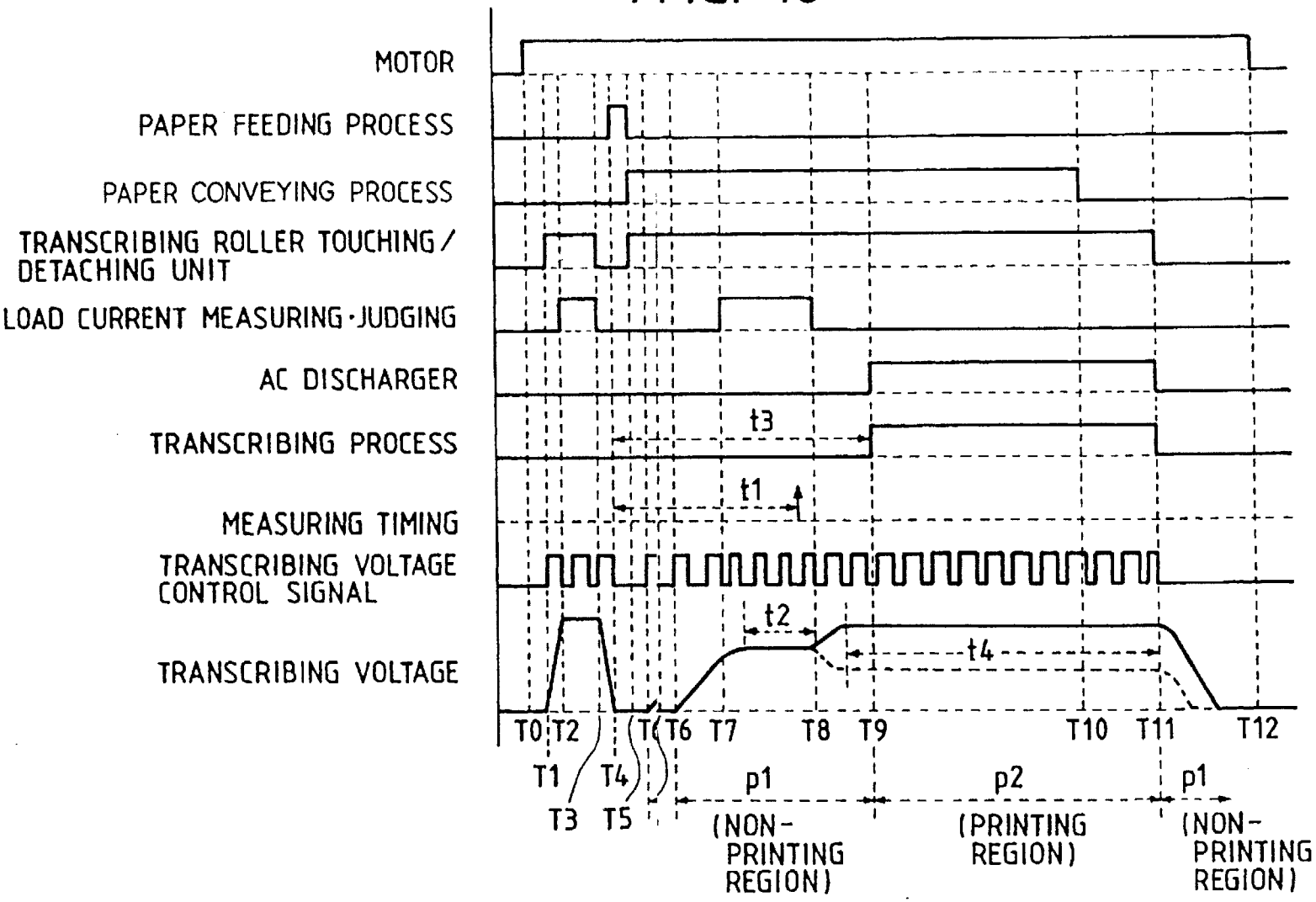
FIG. 16 is a time chart showing another embodiment of the control performed by a control unit in a color laser printer according to the present invention.
Figure 17:
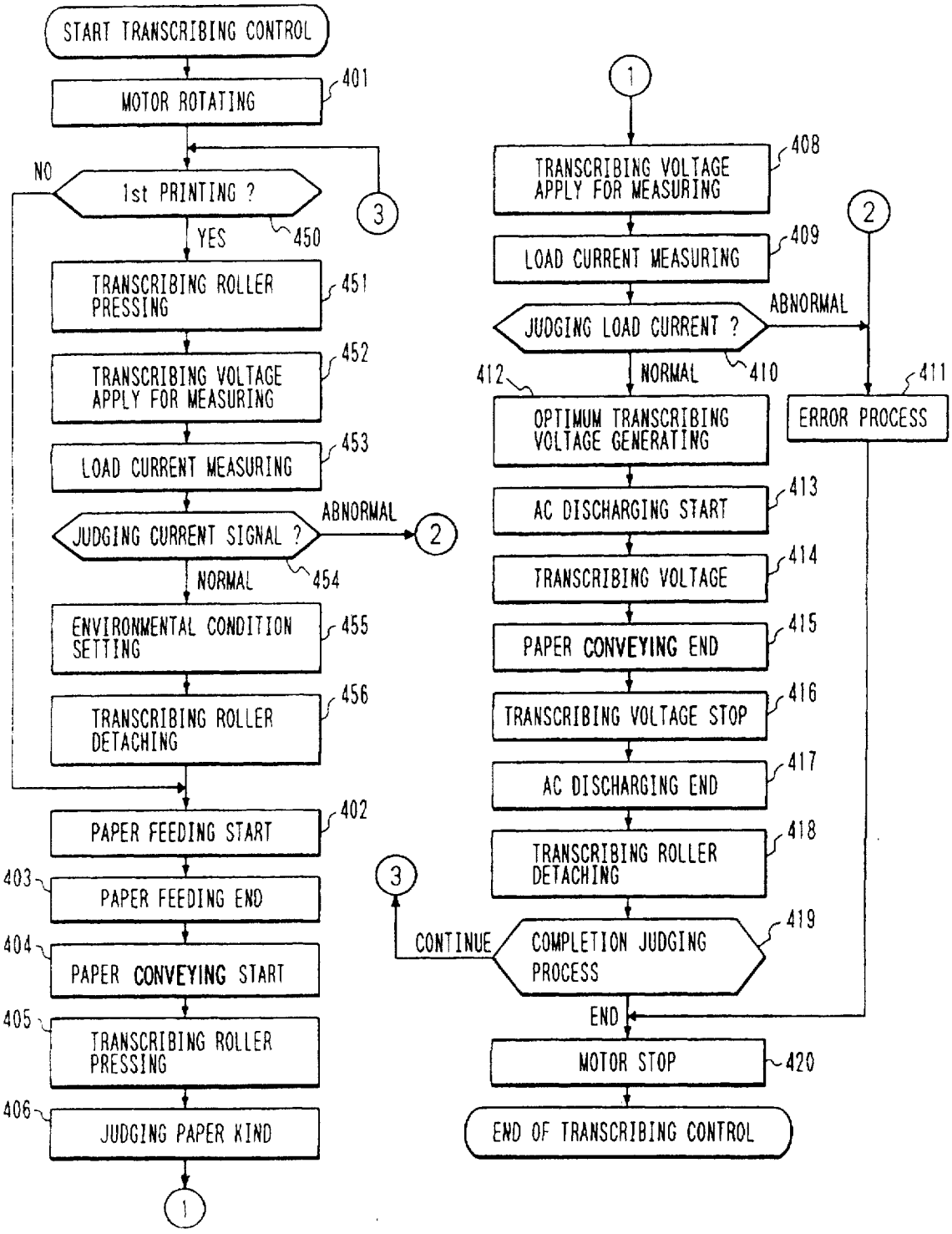
FIG. 17 is a flow chart of a control program performed in the control exemplified by the time chart in FIG. 16.

Another embodiment in which environmental conditions are taken into consideration will be described below, referring to the time chart in FIG. 16 and the flow chart in FIG. 17. The transcribing control starts after completion of the forming of a color toner image on the outer surface of the transcribing drum 6.

At the time T0 after the starting of transcribing control, motor rotating process 401 is executed to generate a motor driving instruction signal S1 from the system controller 106 in order to start the operation of the motor.

At the time T1, it is determined whether printing is carried out for a first page or not in process 450. If the printing is of a first page, the processing goes to the transcribing roller pressing process 451. If not, the processing goes to the paper feed starting process 402.

In a case where the printing is of a first page, at the time T1, the transcribing roller pressing process 415 is executed to generate a transcribing roller pressing driving signal S2 from system controller 106 in order to operate the transcribing roller touching /detaching unit 12 such that the transcribing roller 11 is pressed against the transcribing drum 6. In addition to this, a transcribing voltage is applied for measuring process 452 to generate a transcribing voltage control signal S3 from the system controller 106 for measuring the environmental conditions at that time.

At the time T2, the load current measuring process 453 is started. The measured load current is converted into a detected characteristic signal S6 by the signal converter 109 and is sent to the system controller 106. In the load current judging process 454, it is determined is executed whether the detected characteristic signal S6 is normal or abnormal. If it is normal, the processing goes to process 455. If it is abnormal, error processing is executed in error process 411, and then the transcribing control is ended by executing the motor stop process 420 which will be described later. In a case where the detected characteristic signal is normal, in process 455, an environmental condition corresponding to the detected characteristic signal S6 is selected from a data table which has been stored in advance in the read only memory 101 with reference to the detected characteristic signal S6, and then a transcribing voltage for measuring is determined as described later.

Figure 18:
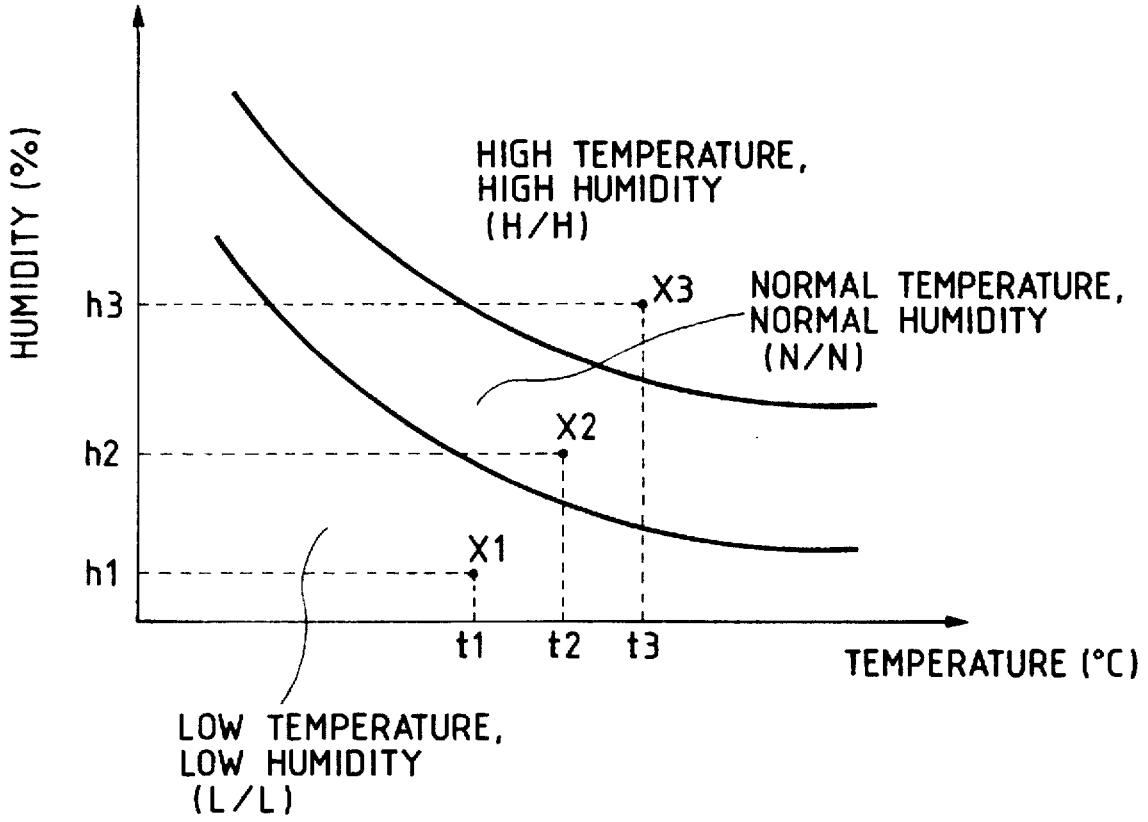
FIG. 18 is an environmental characteristic diagram.

FIG. 18 shows the environmental characteristics of temperature and humidity. Supposing that the detected characteristic signal S6 is at X1, a low temperature/low humidity is judged as a result of referring from the data table and the transcribing voltage for measuring is determined as V1. Since each optimum transcribing voltage for measuring under an environmental condition differs from the others the, selection of an environmental condition here leads to an optimum transcribing control.

At the time T3, the transcribing roller detaching process 456 is executed such that the transcribing roller 11 is detached from the transcribing drum 6.

At the time T4, the paper feed starting process 402 is executed to rotate the paper feed roller 9 in order to extract paper 8 stored in the paper feed cassette 7 and to convey the paper 8 to the register roller 10.

At the time T5, the paper feeding is finished in the paper feed completing process 403, the paper being rearranged and the paper conveying timing being adjusted with the color toner image on the outer surface of the transcribing drum 6 in the paper conveying starting process 404, the transcribing roller touching/detaching driving signal S2 to operate the transcribing roller touching/detaching unit 12 so as to press the transcribing roller 11 against the transcribing drum 6 being generated from the system controller 106 in the transcribing roller pressing process 405. Then, the kind of paper 8 being used (paper for a plain paper copier or paper for an overhead projector) is judged based on the input information set in the operating panel 50 or the detected signal from the detector in the paper kind judging process 406.

At the time T6, the transcribing voltage control signal S3 is generated from the system controller 106 so as to apply the transcribing voltage for measuring in order to measure the electric characteristic of the paper 8 in the transcribing voltage apply for measuring process 408. The time described above is prior to the time when the top front edge of the paper 8 conveyed from the register roller 10 reaches the place between the transcribing drum 6 and the transcribing roller 11. At the time T7, the transcribing voltage for measuring corresponding to the transcribing voltage control signal S3 selected in the process 455 is applied to the transcribing roller 11.

At the time T6, the load current measuring process 409 starts. The load current measuring is performed at the time when a fixed value of t1 has elapsed since the paper feed starting process 402, and within the interval t2 when the transcribing voltage for measuring is stabilizing and within the interval p1 when the top front edge of the paper 8 is within a non-printing region. The measured load current is converted to a characteristic detected signal S6 corresponding to the kind of the paper 8 with the signal converter 109 to be transmitted to the system controller 106. It is judged in the process 410 whether the characteristic detected signal S6 is normal or abnormal. If it is normal, the processing goes to the process 412. If it is abnormal, error processing is executed in the error process 411, and then the motor stopping process 420, which will be described later, is executed to stop the transcribing control.

When the characteristic signal is normal, the optimum transcribing voltage generating process 412 is started at the time T8. In this process 412, the data to generate an optimum transcribing voltage corresponding to the characteristic detected signal S6 is selected from a data table which has been stored in advance in the read only memory 10 corresponding to the characteristic detected signal S6, and the transcribing voltage to be applied to the transcribing roller 11 from the power source 13 is optimized by changing the transcribing voltage signal S3 generated with the system controller 106 based on the data.

The data table described above formed in the read only memory 102 contains each voltage data corresponding to environmental condition for each group of media. Thus, in a case where the paper 8 is a paper for plain paper copier, a transcribing voltage control signal S3 is generated according to the voltage data for a group of media A. In a case where the paper 8 is paper for an overhead projector, a transcribing voltage control signal S3 is generated according to the voltage data for a group of media B.

The time T9 is the timing for starting the transcribing of a color toner image, the AC discharging control signal S5 to bring the alternating current discharging unit 14 in operating condition is generated from the system controller 106 in the process 413, and the transcribing managing process 414 is started. Therewith, the color toner image on the outer surface of the transcribing drum 6 is transferred to the paper 8, the paper which has received the color toner image being discharged with the alternating current discharger 14, after which it is separated from the transcribing drum 6 so as to be conveyed to the fixing unit 15. The color toner image transcription is started at the time T6 when a fixed value of t3 has elapsed since the paper feed starting process 402, within the interval t4 when the optimum transcribing voltage is stabilizing and before the time when the paper 8 is on the boundary between a non-printing region p1 and a printing region p2.

The paper transmitting completion process 415 is executed at the time T10.

At the time T11, the transcribing of the color toner image from the transcribing drum 6 to the paper 8 is completed. With detection of this timing in the transcribing managing process 414, the transcribing voltage control signal S3 is changed so that the generation of the transcribing voltage is stopped in the process 416, the AC discharging control signal S5 being changed so that the operation of the alternating current discharging unit 14 is stopped, and the transcribing roller touching/detaching driving signal S2 is changed so that the transcribing roller 11 is detached from the transcribing drum 6 in the process 418.

At the time T12, it is judged in the completion judging process 419 whether printing is to be continued or whether it is completed using the signal from the input/output interface 104. When printing is to be continued, the processing returns to the first print judging process 450 to perform the transcribing control processing for the next page. When the printing is completed, the motor driving instruction signal S1 is changed so that the motor 20 is stopped in the process 420, and the transcribing control process is completed.

According to the transcribing voltage control described above, the transcribing voltage corresponding to each environmental condition can be measured based on the detected value of the environmental condition, and the transcribing voltage control characteristic based on the electric characteristic of paper measured with this voltage is changed depending on the kind of paper being used. Therefore, a high transcribing efficiency can be kept independent of the materials of the paper such as paper for a plain paper copier or paper for an overhead projector used in a color laser printer.

While there has been described various embodiments of color laser printers, the present invention can be widely and effectively applied to electro-photographic apparatus using transcription units of the transcribing roller type.

According to the present invention, since the transcribing voltage control characteristic based on the measured electric characteristic of the paper is changed depending on the kind of paper (material and/or size), a transcribing voltage suitable for the paper being used can be applied to the transcribing roller even when paper a different material, such as paper for a plain paper copier or paper for an overhead projector, and/or of different size, is used in a color printer. Therefore, a high transcribing efficiency can be kept independent of the materials of the paper.

Further, since the measurement of the electric characteristic of the paper is performed by detecting the load current flowing through the transcribing roller under a condition where the alternating current discharging unit is stopped noise in detecting a very weak load current can be decreased, and a high detecting accuracy can be attained to improve reliability.

We claim:

1. An electro-photographic apparatus, comprising: a toner image holding body; a toner image forming means for forming a toner image on a rotating said toner image holding body; a conveying means for conveying a recording medium on which said toner image formed on said toner image holding body is to be transcribed; a transcription unit to transcribe a toner image from said toner image holding body onto said recording medium conveyed by said conveying means; a fixing means for fixing said toner image on said recording medium; said transcription unit having a transcribing voltage control means for controlling a transcribing voltage, wherein said transcribing voltage control means comprises:

a judging means for judging whether printing is of a first page or not:

a first measuring means for measuring when printing is of said first page as judged by said judging means, an electric characteristic of said toner image holding body prior to a feeding of said recording medium:

a control characteristic setting means for setting a transcribing voltage control characteristic of said transcribing voltage control means based on a measured result of said first measuring means:

a second measuring means for measuring an electrical characteristic of said recording medium within a non-printing region thereof based on said transcribing voltage control characteristic: and generating means for generating an optimum transcribing voltage for a printing region based on a measured result of said second measuring means.

2. An electro-photographic apparatus according to claim 1, wherein said first measuring means measures said electrical characteristic of said toner image holding body using said transcribing voltage control means.

3. An electro-photographic apparatus according to claim 1, wherein said second measuring means measures said electrical characteristic of said recording medium using said transcribing voltage control means.

4. An electro-photographic apparatus according to claim 2, wherein said transcribing voltage control means comprises a data table containing respective values of said transcribing voltage for applying a transcribing voltage corresponding to each material type of said recording medium; and said material type of said recording medium is determined from the measured result of the electric characteristic of said recording medium to determine said transcribing voltage based on said material type.

5. A printing method using an electro-photographic apparatus comprising a toner image holding body, a toner image forming means for forming a toner image on a rotating said toner image holding body, a conveying means for conveying a recording medium on which said toner image formed on said toner image holding body is to be transcribed, a transcription unit to transcribe a toner image from said toner image holding body onto said recording medium conveyed by said conveying means, a fixing means for fixing said toner image on said recording medium, said transcription unit having a transcribing voltage control means for controlling a transcribing voltage, the method comprising the steps of:

judging whether printing is of a first page or not, and if printing is of the first page, then:

measuring an electrical characteristic of said toner image holding body prior to a start of a feeding of said recording medium;

setting a transcribing voltage control characteristic of said transcribing voltage control means based on a measured result of said electrical characteristic of said rotating toner image holding body;

feeding of said recording medium using said conveying means;

measuring an electrical characteristic of said recording medium within a non-printing region;

generating an optimum transcribing voltage for a printing region based on a measured result of said electrical characteristic of said recording medium, and if printing is not of the first page, then;

starting feed of said recording medium using said conveying means;

measuring an electrical characteristic of said recording medium within a non-printing region;

generating an optimum transcribing voltage for said printing region based on a measured result of said electrical characteristic of said recording medium.

6. A printing method according to claim 5, wherein said steps of measuring said electrical characteristic of said toner image holding body means measures said electrical characteristic using said transcribing voltage control means.

7. A printing method according to claim 5, wherein said step of measuring said electrical characteristic of said recording medium measures said electrical characteristic using said transcribing voltage control means.

8. A printing method according to claim 5, wherein said transcribing voltage control means comprises a data table containing respective values of said transcribing voltage for applying a transcribing voltage corresponding to each material type of said recording medium; and the method comprises the further steps of:

determining said material type of said recording medium by measuring an electrical characteristic of said recording medium; and selecting said transcribing voltage from said stored data table based on said determined material type of said recording medium.

* * * * *